US005603626A

United States Patent [19]

Oka et al.

[11] Patent Number: 5,603,626

[45] Date of Patent: Feb. 18, 1997

[54] INTERMEDIATE TERMINAL FOR AN ELECTRICAL CONNECTION BOX

[75] Inventors: Yoshito Oka; Hideki Goto, both of Yokkaichi, Japan

[73] Assignee: Sumitomo Wiring Systems, Ltd., Yokkaichi, Japan

[21] Appl. No.: 520,885

[22] Filed: Aug. 30, 1995

[30] Foreign Application Priority Data

Oct. 26, 1994 [JP] Japan ..... 6-262725

[51] Int. Cl.[6] ..... H01R 27/00

[52] U.S. Cl. ..... 439/224; 439/621

[58] Field of Search ..... 439/218, 222, 439/224, 621, 76.2, 949, 787

[56] References Cited

U.S. PATENT DOCUMENTS 2,965,869 12/1960 Ludwig ..... 439/223
4,460,239 7/1984 Inoue ..... 439/786
5,383,800 1/1995 Saka et al. ..... 439/76.2

FOREIGN PATENT DOCUMENTS

0463608A2 1/1992 European Pat. Off. .

*Primary Examiner*—Neil Abrams
*Assistant Examiner*—Barry Matthew L. Standig
*Attorney, Agent, or Firm*—Anthony J. Casella; Gerald E. Hespos

[57] ABSTRACT

In order to provide an intermediate terminal for an electrical connection box with an enhanced degree of freedom in terms of a tab inserting direction, an intermediate terminal having a column with hollow end portions and connecting spring portions (5*g*–5*j*; 3*b*, 3*c*) projecting inwardly into the hollow interior of the end portions so as to allow the insertion and fitting of a tab (1*a*, 2*a*) at each end portion, wherein the connecting spring portions (5*g*–5*j*; 3*b*, 3*c*) at at least one end portion are provided such that a tab (1*a*, 2*a*) can be inserted and fitted in at least two different rotational orientations with respect to the longitudinal axis of the column.

10 Claims, 5 Drawing Sheets

INTERMEDIATE TERMINAL FOR AN ELECTRICAL CONNECTION BOX

BACKGROUND OF THE INVENTION

1. Field of the Invention

The present invention relates to an intermediate terminal for an electrical connection box and, particularly to an intermediate terminal into which a tab of a busbar mounted in an electrical connection box and a tab of a functional part such as a fuse or a relay are inserted to establish the electrical connection between the busbar and the functional part. Especially, it is designed to mount an intermediate terminal in the electrical connection box independently of a direction in which the tab of the relay or of like mating part is inserted.

2. Description of the Prior Art

An electrical connection box used to connect a wiring harness for an automotive vehicle with a variety of wiring devices is adapted to realize a rational and economical junction connection of the wiring by concentrating points of junction connection on one location. A variety of types of such electrical connection boxes are being developed for different types of vehicles and for different purposes while the wiring harness is made more compact.

In the above junction box, there are mounted intermediate terminals 3, 3 for connecting, for example, tabs 1*a*, 1*a* of a fuse 1 and tabs 2*a*, 2*a* of a busbar or like device mounted in the junction box as shown in FIG. 6(A).

A variety of intermediate terminals 3 having different structures have been proposed. Most of them are directional in the vertical direction and the forward/backward direction, i.e. the shape of the terminals differs at its top and bottom and at its front side and rear side, respectively.

For example, as shown in FIGS. 7(A) and 7(B), the structure of the intermediate terminal 3 has such a shape.

An intermediate terminal 3 formerly proposed by the present inventors and shown in FIGS. 8(A) and 8(B) is non-directional, i.e. has the same structure at its top and bottom and at its front and back, respectively (Japanese Unexamined Utility Model Publication No. 5-79889).

The intermediate terminal 3 shown in FIGS. 8(A) and 8(B) has generally the shape of a rectangular column. At the front and the rear ends of the intermediate terminal 3, respectively, pairs of arcuate connecting spring portions 3*b*, 3*b* and 3*c*, 3*c* project inwardly from its front and rear surfaces 3*a*, 3*a*, forming a clearance between each pair so that the tabs 1*a* or 2*a* can be inserted at will from top or bottom. Generally, the tab 1*a* of the fuse 1 is inserted into the clearance between the connecting spring portions 3*b* and 3*b* at the top end of the intermediate terminal 3, whereas the tab 2*a* of the busbar or like device is inserted into the clearance between the connecting spring portions 3*c* and 3*c* at the bottom end thereof.

However, only the upper and lower ends of the intermediate terminal are identical in that terminals can be inserted from any end. Accordingly, if the tab 1*a* is mounted in a different direction (e.g. turned about its axis by 90°), the intermediate terminal 3 has to be mounted in the junction box so that the tab 1*a* can be inserted thereinto. Then, the intermediate terminal 3 cannot be used unless the tab 1*a* of the fuse 1 and the tab 2*a* of the busbar or like device extend in the same direction as shown in FIG. 6(A).

Accordingly, in the case where the tabs 2*a*, 2*a* of the busbars or like devices are opposed each other, and thus turned by 90°, as shown in FIG. 6(B), such a problem arises where the tabs 2*a*, 2*a* can be inserted into the ends of the intermediate terminals 3, 3, but the tabs 1*a*, 1*a* of the fuses 1 cannot be inserted into the other ends of the intermediate terminals 3, 3.

Further, in the case where 10 to 30 fuses 1 are mounted in the electrical connection box, twice as many intermediate terminals, namely, 20 to 60 intermediate terminals are required. In this case, even if the respective tabs 1*a* and 2*a* extend in the same direction, when one fuse 1' is mounted in a different direction (rotated by 90°) as shown in FIG. 9, the intermediate terminals 3 to be connected with this fuse 1 needs to be turned in conformity with the mounting direction of this fuse 1'. This makes the construction of an apparatus for automatically inserting the intermediate terminal 3 complicated, thereby leading to an increased production cost.

If the fuses 1 are mounted in the same direction in order to avoid this problem, a design of an internal circuitry of the electrical connection box is subject to more limitation.

The invention is developed to solve the above problems, and an object thereof is to provide a more versatile intermediate terminal.

SUMMARY OF THE INVENTION

The tab (which could be seen as a rotationally directional connection terminal) which is typically a tab with a rectangular cross section can be inserted in at least one end portion in at least two different rotational orientations. Accordingly, if the tabs (connection terminals) to be inserted into the other end portions are aligned in one rotational direction, the connection terminals to be inserted into the one end portion need not be aligned. Conclusively, the inventive intermediate terminals can be used for this type of connection without being turned about their longitudinal axes.

Preferably, two receiving portions for receiving connection terminals at a different rotational orientation are formed. If both end portions are provided with two receiving portions, the above type of connection can be made even without aligning the intermediate terminals with respect to their up/down orientation. Preferably, the two receiving portions intersect at a right angle.

In a preferred embodiment, the column has a generally rectangular cross section, and the connecting spring portions are provided at each side of the column. This embodiment is easy to manufacture. Preferably, the connecting spring portions have an arcuate cross section and define two receiving portions. It is particularly preferred that the connecting spring portions are formed throughout the entire longitudinal extension of the column. Namely, the intermediate terminal is now particularly easy to manufacture, e.g. by bending and folding a plate.

According to another preferred embodiment, the column has a cross-like cross section defining four wings, wherein each two opposing wings define a receiving portion and wherein the connecting spring portions are formed at the sides of the wings. This embodiment allows easy and smooth insertion of the connection terminals.

The intermediate terminal is easy to manufacture if the column is entirely hollow, particularly if also the connecting spring portions are formed over the entire length.

If the column has generally a square shape, and the cross-section of its interior is point symmetrical, the intermediate terminal is easy to handle, particularly by an automatic connecting apparatus.

In other words, since two intersecting tab receiving portions are formed in one intermediate terminal, the intermediate terminals can be mounted in the electrical connection box in the same direction independently of inserting directions of tabs. Further, even if a tab of a fuse or like device and a tab of a busbar or like device extend in different directions, i.e., their extending directions are displaced by 90°, the respective tabs can be inserted into the intermediate terminal.

BRIEF DESCRIPTION OF THE DRAWINGS

These and other objects, features and advantages of the present invention will become more apparent upon a reading of the following detailed description and accompanying drawings in which.

DETAILED DESCRIPTION OF THE PREFERRED EMBODIMENT

Figure 1:
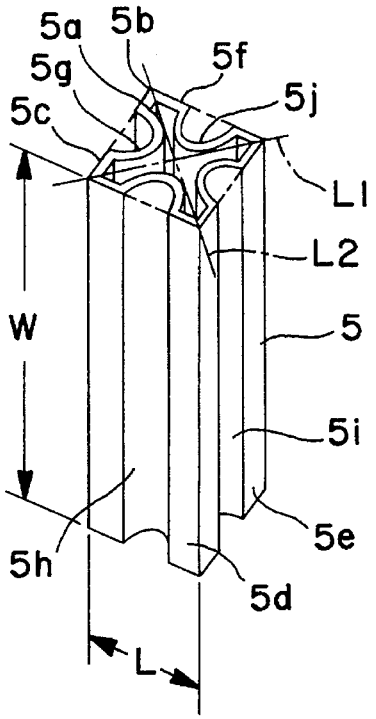
FIG. 1 is a perspective view of a intermediate terminal as a first embodiment according to the invention.

It should be appreciated that no detailed description is given to elements having the same construction and operation as the prior art shown in FIGS. 6 to 9 by identifying them by like reference numerals.

Figure 2:
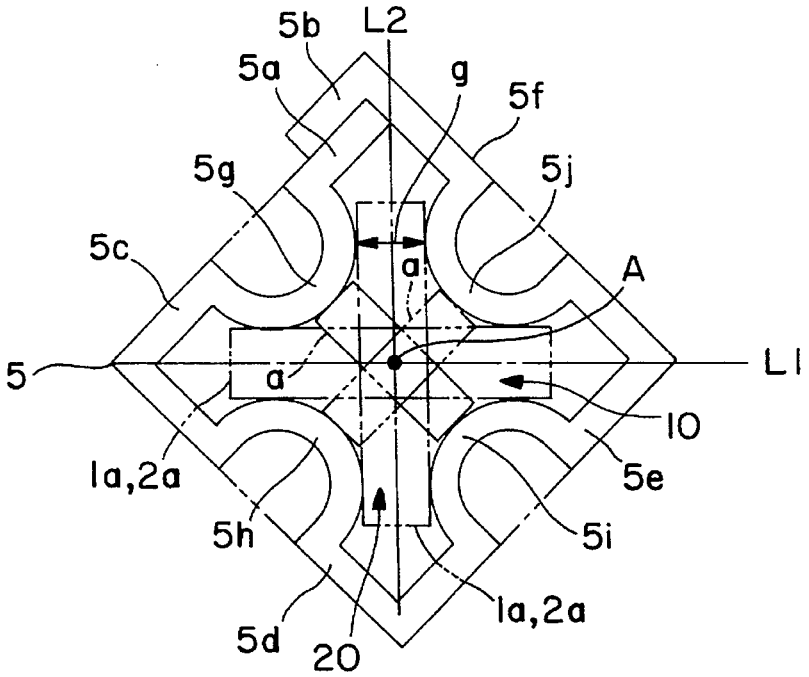
FIG. 2 is a plan view of the intermediate terminal.

A intermediate terminal 5 as a first embodiment has the form of a substantially square column of a conductive material (e.g. metal) as indicated by phantom line in FIGS. 1 and 2.

Specifically, the intermediate terminal 5 is formed from a metal plate having a width W corresponding to a height of the intermediate terminal 5. The plate is folded along parallel fold lines to define four sides having generally the same length L. The folds are formed such that each side defines an angle of 90° to adjacent sides. Forming proceeds by placing a finishing end 5*b* over the outer surface of a starting end 5*a*, and connecting the ends 5*a* and 5*b* as shown in FIG. 2.

Therefore, four surfaces 5*c*, 5*d*, 5*e* and 5*f* of the intermediate terminal 5 have generally the same shape.

Arcuate connecting spring portions 5*g*, 5*h*, 5*i* and 5*j* projecting semicircularly inwardly extend throughout the entire longitudinal extension of the terminal 5 in the lateral center of the surfaces 5*c* to 5*f*, respectively.

Accordingly, clearances g for permitting insertion of a tab 1*a* of a fuse 1 or a tab 2*a* of a busbar or like device are formed between the inner surfaces of the connecting spring portions 5*g* and 5*h*, 5*h* and 5*i*, 5*i* and 5*j*, 5*j* and 5*g* and are, thus, positioned at four corners defined by the surfaces 5*c* and 5*d*, 5*d* and 5*e*, 5*e* and 5*f*, 5*f* and 5*c*, respectively.

In other words, there are formed first and second tab receiving portions 10 and 20 which extend through and intersect at a longitudinal axis A at a right angle. The inner surfaces of the connecting spring portions 5*g* and 5*h* at one diagonal end of the square terminal 5 and 5*i* and 5*j* at the opposite diagonal end are respectively opposed to each other with the first tab receiving portion 10 therebetween. The inner surfaces of the connecting spring portions 5*g* and 5*j* at one diagonal end of the square terminal 5 and 5*h* and 5*i* at the opposite diagonal end are opposed to each other with the second tab receiving portion 20 therebetween.

In FIGS. 1 and 2, the first and second tab receiving portions 10 and 20 extend along lines L1 and L2, respectively.

Figure 3A:
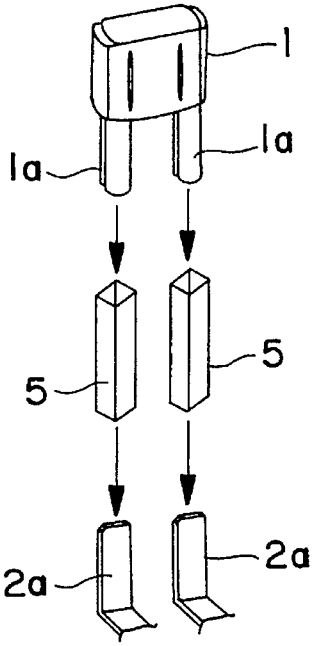
FIG. 3(A) is a perspective view showing a relationship of a fuse, intermediate terminals and busbars or like devices.

The intermediate terminals 5 can be mounted in the same direction in one electrical connection box 30 as shown in FIG. 3(A), independently of whether the tabs 2*a* of each busbar mounted in the electrical connection box 30 extend along the longitudinal or lateral direction orthogonally thereto and are inserted into a lower part of either the first or second tab receiving portion 10 or 20.

Further, the tabs 1*a* of relays 1A, 1B and 1C to be connected with the intermediate terminals 5 thus connected with the tabs 2*a* of the busbars mounted in the electrical connection box 30 can be inserted into upper parts of the first or second tab receiving portions 10 or 20 independently of whether the tabs 1*a* extend along the longitudinal or lateral direction.

Figure 3B:
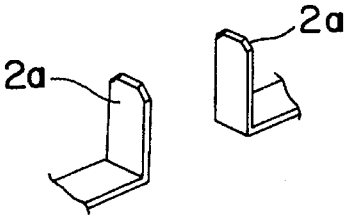
FIG. 3(B) is a perspective view showing the tabs of busbars opposed to each other.
Figure 4:
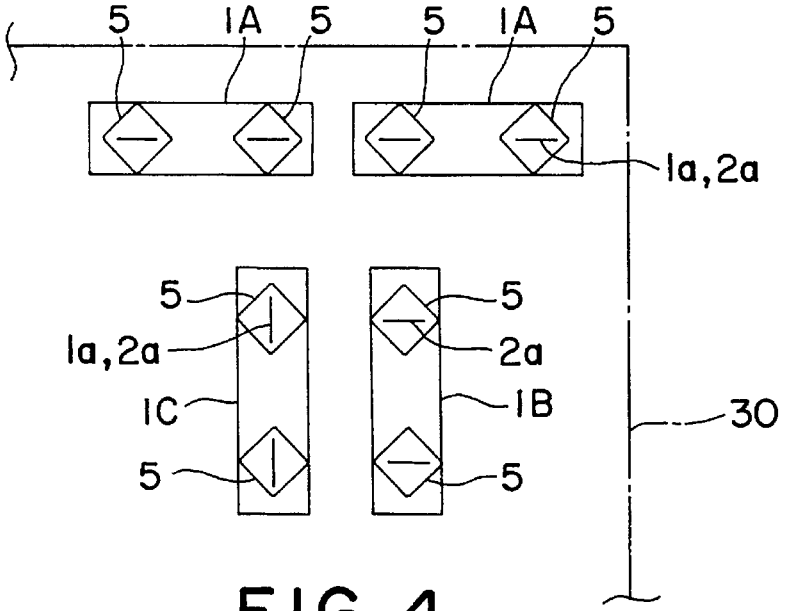
FIG. 4 is a plan view showing mounting directions of fuses in an electrical connection box.

In other words, the tabs can be connected by means of the intermediate terminals 5 mounted in the same direction in the electrical connection box 30 both when the tabs 1*a*, 1*a* of the fuses 1 and the tabs 2*a*, 2*a* of the busbars 2 to be inserted into the first or second tab receiving portions 10 or 20 extend in the same direction as shown in FIG. 3(A) and as in fuses 1A, 1A of FIG. 4, and when the tabs 1*a*, 1*a* of the fuses 1 and the tabs 2*a*, 2*a* of the busbars 2 extend in different directions as shown in FIG. 3(B) and as in fuses 1B, 1C of FIG. 4.

Specifically, when the tabs 1*a*, 1*a* of the fuse 1 and the tabs 2*a*, 2*a* of the busbars 2 extend in the same direction as shown in FIG. 3(A), if the intermediate terminals 5 are mounted from above such that the tabs 2*a*, 2*a* are inserted into the lower parts thereof, the tabs 2*a*, 2*a* are tightly held between the connecting spring portions 5*g* and 5*h*, 5*i* and 5*j* (or 5*g* and 5*j*, 5*h* and 5*i*) as shown in FIG. 2.

Thereafter, when the tabs 1*a*, 1*a* of the fuse 1 are inserted from above into the upper parts of the respective intermediate terminals 5, 5, the tabs 1*a*, 1*a* are tightly held between the same connecting spring portions 5*g* and 5*h*, 5*i* and 5*j* (or 5*g* and 5*j*, 5*h* and 5*i*) as the tabs 2*a*, 2*a* of the busbars 2.

On the other hand, when the tabs 2*a*, 2*a* of the busbars are opposed to each other as shown in FIG. 3(B) and therefore extend in the different direction from the tabs 1*a*, 1*a* of the fuse 1 (see the fuse 1B in FIG. 4), if the intermediate terminals 5, 5 are mounted from above regardless of the direction thereof such that the tabs 2*a*, 2*a* are inserted into the lower parts thereof, the tabs 2*a*, 2*a* are tightly held between the connecting spring portions 5*g* and 5*j*, 5*h* and 5*i* (or 5*g* and 5*h*, 5*i* and 5*j*) as shown in FIG. 2.

Thereafter, when the tabs 1*a*, 1*a* of the fuse 1 are inserted from above into the upper parts of the respective intermediate terminals 5, 5, the tabs 1*a*, 1*a* are tightly held between the connecting spring portions 5*g* and 5*j*, 5*h* and 5*i* (or 5*g* and 5*h*, 5*i* and 5*j*) differently from the tabs 2*a*, 2*a* of the busbars.

Further, even when the tabs 1*a*, 1*a* of the fuse 1 extend in the same direction as the tabs 2*a*, 2*a* of the busbars as with the fuse 1A of FIG. 4, but the fuse 1 is mounted in the different direction (rotated by 90°) as the fuse 1C of FIG. 4, if the intermediate terminals 5, 5 are mounted from above regardless of the direction thereof such that the tabs 2*a*, 2*a* are inserted into the lower parts thereof, the tabs 2*a*, 2*a* are tightly held between the connecting spring portions 5*g* and 5*h*, 5*i* and 5*j* (or 5*g* and 5*j*, 5*h* and 5*i*) as shown in FIG. 2.

Thereafter, when the tabs 1*a*, 1*a* of the fuse 1 are inserted from above into the upper parts of the respective intermediate terminals 5, 5, the tabs 1*a*, 1*a* are tightly held between the same connecting spring portions 5*g* and 5*h*, 5*i* and 5*j* (or 5*g* and 5*j*, 5*h* and 5*i*) as the tabs 2*a*, 2*a* of the busbars.

As described above, the tabs 1*a*, 1*a* and 2*a*, 2*a* can be inserted into the intermediate terminals 5, 5 even if the tabs 1*a*, 1*a* of the fuse 1 extend in the direction displaced by e.g. 90° from the tabs 2*a*, 2*a* of the busbars. Accordingly, even if the fuses 1 are mounted in different directions (rotated by 90°) in the electrical connection box, the intermediate terminals 5, 5 need not be aligned in conformity with the mounting directions of the fuses 1. Thus, the automatic intermediate terminal inserting apparatus is allowed to have a simple construction, thereby reducing a production cost.

Further, since it is not necessary to mount the fuses 1 in the same direction, a design of an internal circuitry of the electrical connection box is subject to less limitation.

Furthermore, the tabs 1*a*, 1*a* of the fuse 1 and the tabs 2*a*, 2*a* of the busbar may even be inserted into clearances between apexes of the facing arcuate connecting spring portions 5*g* and 5*i*, 5*h* and 5*j* as indicated by dashed line in FIG. 2. However, the tabs must have a specified width. To the contrary, if the tabs are inserted into the tab receiving portions, they need not have a specified width, but a specified thickness.

Figure 5:
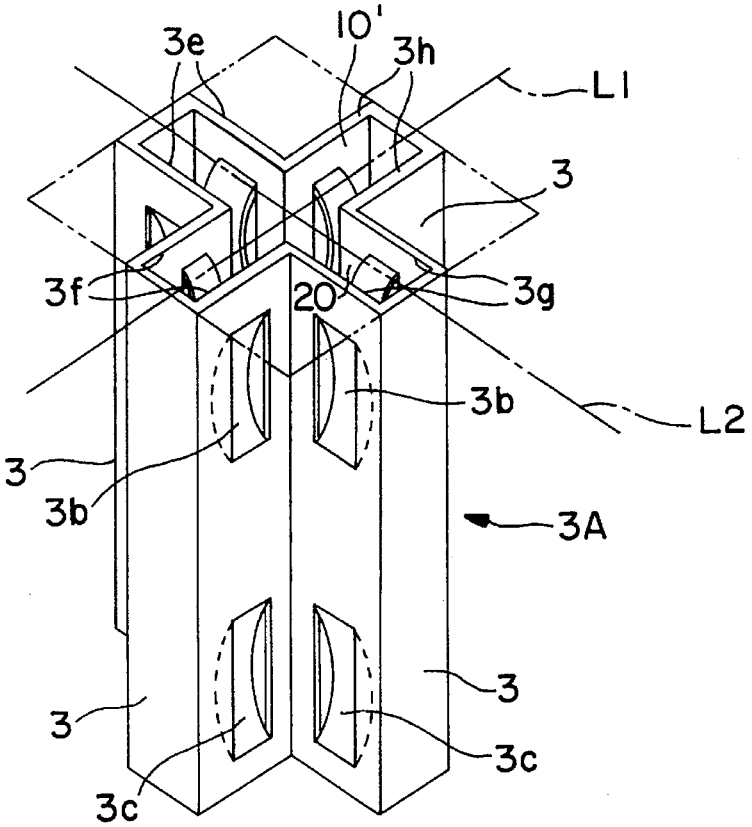
FIG. 5 is a perspective view of an intermediate terminal as a second embodiment.
Figure 6A:
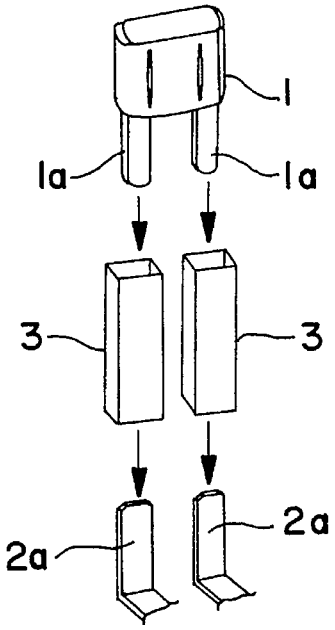
FIG. 6(A) PRIOR ART
FIG. 6(A) is a perspective view showing a relationship of a fuse, prior art intermediate terminals and busbars or like devices.
Figure 6B:
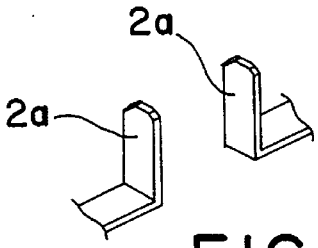
FIG. 6(B) PRIOR ART
FIG. 6(B) is a perspective view opposed to each other.
Figure 7A:
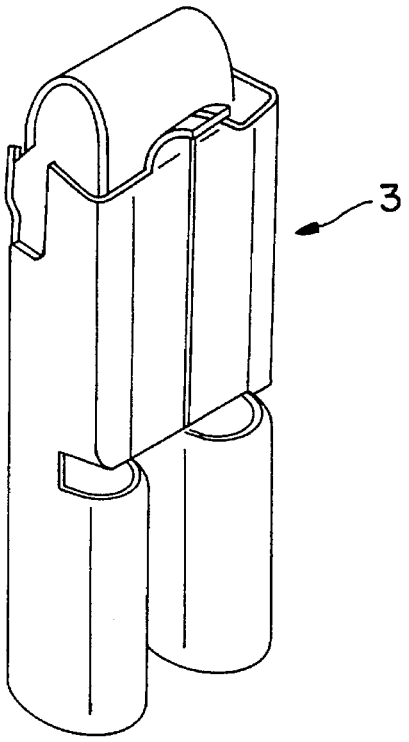
FIG. 7(A) PRIOR ART
FIGS. 7(A) and 7(B) are a perspective view and a side view of a prior art intermediate terminal, respectively.
Figure 7B:
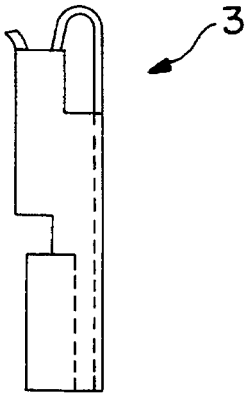
FIG. 7(B) PRIOR ART
Figure 8A:
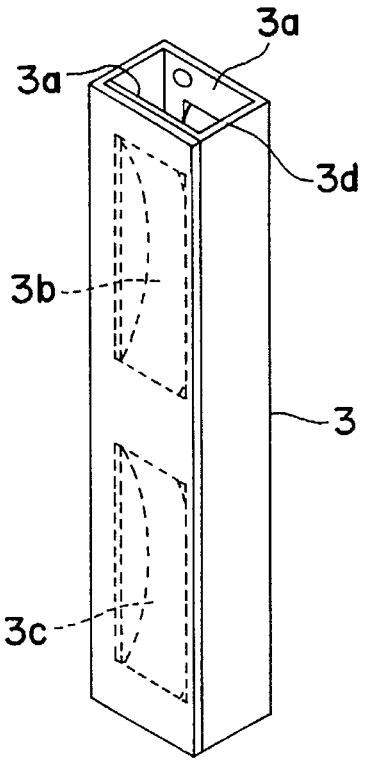
FIG. 8(A) PRIOR ART
FIG. 8(A) is a perspective view of another prior art intermediate terminal.
Figure 8B:
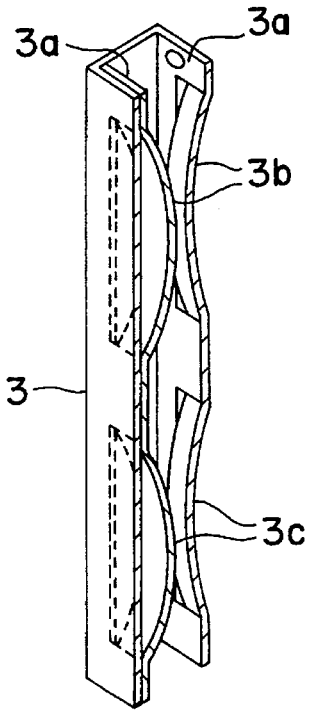
FIG. 8(B) PRIOR ART
FIG. 8(B) is a perspective view partially in section showing an essential portion of the intermediate terminal shown in FIG. 8(A)
Figure 9:
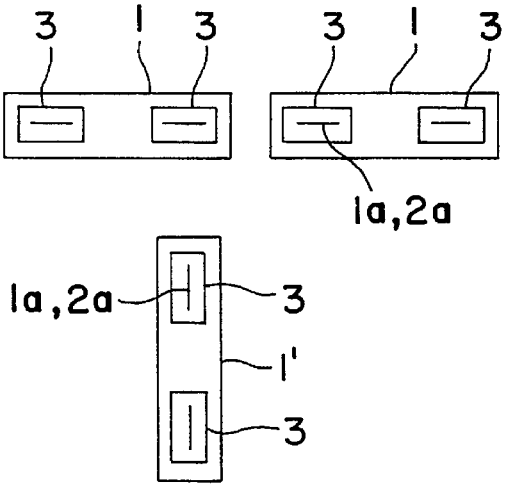
FIG. 9 PRIOR ART
FIG. 9 is a plan view showing mounting directions of fuses in a prior art electrical connection box.

FIG. 5 shows an intermediate terminal 3A as a second embodiment which employs the basic construction of the prior art intermediate terminal 3 shown in FIG. 8. The intermediate terminal 3A looks as if it were formed by cutting away one side surface 3*d* shown in FIG. 8(A) from the intermediate terminal 3, and joining four such intermediate terminals 3 to have a cross-like cross section by bringing the cut edges into abutment. In reality, the intermediate terminal 3*a* is formed by bending and embossing a metal plate similar to the intermediate terminal 5.

The intermediate terminal 3A is in the form of a cross-like column. Surfaces 3*e* to 3*h* face each other.

In the intermediate terminal 3A as the second embodiment, there are also formed two tab receiving portions, namely a first tab receiving portion 10' and a second tab receiving portion 20' which intersect at right angles. Accordingly, if the intermediate terminals 3A are mounted in the same direction in the electrical connection box, the tabs of the busbars can be connected with the corresponding tabs of the relays by means of the intermediate terminals independently of whether the tabs extend in the longitudinal or lateral direction.

As is clear from the above description, in the inventive intermediate terminals, the connecting spring portions are formed on the side surfaces of the rectangular column which surfaces are point-symmetrical with respect to a middle point of two intersecting directions. Accordingly, even if a tab of a fuse or like device and a tab of a busbar or like device extend in different directions, i.e., their extending directions are displaced by e.g. 90°, the respective tabs can be inserted into the same intermediate terminal. Therefore, even if fuses or like devices are mounted in different directions in the electrical connection box (rotated by 90°), the intermediate terminals need not be aligned in accordance with the mounting direction of the fuses. This makes the construction of an automatic intermediate terminal inserting apparatus simple, thereby reducing a production cost.

Further, since it is not necessary to mount the fuses or like devices in the same direction, a design of an internal circuitry of the electrical connection box is subject to less limitation.

What is claimed is:

1. An intermediate terminal for electrical connection with a generally planar tab, said intermediate terminal having a column with hollow end portions dimensioned for receiving said tab, a plurality of connecting spring portions (5*g*–5*j*; 3*b*, 3*c*) projecting inwardly into the hollow end portions so as to allow insertion and fitting of a tab (1*a*, 2*a*) in each end portion, said connecting spring portions being disposed such that a plurality of said connecting spring portions resiliently engage said tab in a first rotational orientation of said tab relative to said column and such that a plurality of said connecting spring portions resiliently engage said tab in a second rotational orientation of said tab, said second rotational orientation being rotated from said first rotational orientation by less than 180°, wherein the connecting spring portions (5*g*–5*j*; 3*b*, 3*c*) at at least one end portion are provided such that a tab (1*a*, 2*a*) can be inserted and fitted in at least two different rotational orientations with respect to the longitudinal axis of the column.

2. An intermediate terminal according to claim 1, wherein the column has a generally rectangular cross section and wherein the connecting spring portions (5*g* –5*j*) are formed at each side of the column.

3. An intermediate terminal according to claim 2, wherein the connecting spring portions (5*g* –5*j*) have an arcuate cross section and define two receiving portions (10,20).

4. An intermediate terminal according to claim 2, wherein the connecting spring portions (5*g* –5*j*) are formed throughout the entire longitudinal extension of the column.

5. An intermediate terminal according to claim 1, wherein the column has a cross-like cross section defining four wings (3,3,3,3), wherein each two opposing wings define a receiving portion (10', 20') and wherein the connecting spring portions (3*b*, 3*c*) are formed at sides of the wings (3,3,3,3).

6. An intermediate terminal according to claim 1, wherein the column has a generally square shape and wherein the cross-section of its interior is point-symmetrical with respect to its longitudinal axis.

7. An intermediate terminal according to claim 1, wherein said hollow end portions are configured such that said second rotational orientation is 90° rotated from said first rotational orientation.

8. An intermediate terminal according to claim 1, wherein said column has a generally rectilinear cross-section defined by four consecutively interconnected sides, each said side having an elongate inwardly projecting arcuate region extending between the ends of said column, said arcuate regions being dimensioned such that a tab is resiliently engageable between the arcuate regions of two of said interconnected sides and between the arcuate regions of the other two of said interconnected sides of said column.

9. An intermediate terminal for electrical connection with a generally planar tab, said intermediate terminal defining an elongate column with opposed open end portions and a hollow interior extending between the opposed open end portions, said column being of generally rectangular cross-sectional shape and having first through fourth consecutively articulated sides, said first through fourth sides having, respectively, first through fourth arcuate connecting spring portions projecting semicircularly inwardly along said terminal between the opposed end portions of the column, the connecting spring portions being dimensioned such that, in a first orientation, one side of said tab is resiliently engaged by the first and second connecting spring portions while the other side of said tab is resiliently engaged by the third and fourth connecting spring portions, and such that in a second orientation, one side of said tab is resiliently engaged by the first and fourth connecting spring portions while the other side of the tab is resiliently engaged by the second and third connecting spring portions.

10. An intermediate terminal for electrical connection with a generally planar tab, said intermediate terminal defining a column with opposed open end portions and a hollow interior extending between the opposed open end portions, said column defining a cross-shaped cross-section forming two orthogonally aligned tab receiving portions, a plurality of connecting spring portions projecting inwardly into each of the tab receiving portions for resiliently engaging a tab inserted therein.

* * * * *